US008991883B1

(12) United States Patent
Butterfield, IV

(10) Patent No.: US 8,991,883 B1
(45) Date of Patent: Mar. 31, 2015

(54) CONNECTION FIXTURE FOR ATTACHING TO A SUBSTANTIALLY PLANAR STRUCTURE AND A METHOD FOR USE THEREOF

(71) Applicant: Albert Eugene Butterfield, IV, Novato, CA (US)

(72) Inventor: Albert Eugene Butterfield, IV, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 65 days.

(21) Appl. No.: 14/042,909

(22) Filed: Oct. 1, 2013

(51) Int. Cl.
*B66C 1/28* (2006.01)
*B66C 1/66* (2006.01)

(52) U.S. Cl.
CPC .... *B66C 1/28* (2013.01); *B66C 1/66* (2013.01)
USPC ..... 294/67.3

(58) Field of Classification Search
CPC ..... B66C 1/28; B66C 1/62; B66C 1/64; B66C 1/66
USPC ..... 294/67.1, 67.3, 67.33, 82.13, 85, 215
See application file for complete search history.

(56) References Cited

U.S. PATENT DOCUMENTS

| | | | | |
|---|---|---|---|---|
| 2,791,461 | A * | 5/1957 | Goldenberg | 294/85 |
| 2,961,269 | A * | 11/1960 | Renfroe | 294/85 |
| 3,632,152 | A * | 1/1972 | Renfroe | 294/85 |
| 4,371,203 | A * | 2/1983 | Munro | 294/119.1 |
| 4,530,536 | A * | 7/1985 | Williams | 294/118 |
| 4,767,091 | A * | 8/1988 | Cuny | 248/228.4 |
| 7,943,087 | B2 | 5/2011 | McGuire et al. | |
| 8,622,448 | B1 * | 1/2014 | Butterfield, IV | 294/67.1 |
| 2010/0032031 | A1 | 2/2010 | Neal | |
| 2012/0107084 | A1 * | 5/2012 | Krogh | 414/800 |

OTHER PUBLICATIONS

U.S. Appl. No. 13/483,986, filed May 30, 2012. (34 Pages).
U.S. Appl. No. 13/804,858, filed Mar. 14, 2013. (23 Pages).

* cited by examiner

*Primary Examiner* — Dean Kramer
(74) *Attorney, Agent, or Firm* — Karen R. DiDomenicis

(57) ABSTRACT

Disclosed is a connection fixture capable of attaching without the use of bolts to a substantially planar structure having a plurality of vertical holes therein to be lifted to facilitate the lifting thereof. In one embodiment, the connection fixture includes first and second bracket portions capable of interlocking with one another and securely holding the substantially planar structure. In the interlocked position, the connection fixture has a pair of generally C shaped lips which surround the edges of the substantially planar structure, a pin which engages a vertical hole in the substantially planar structure, and a pair of aligned transverse holes. A shackle can be secured through the aligned transverse holes in the connection fixture.

8 Claims, 8 Drawing Sheets

CONNECTION FIXTURE FOR ATTACHING TO A SUBSTANTIALLY PLANAR STRUCTURE AND A METHOD FOR USE THEREOF

FIELD

The present disclosure relates to connection fixtures of the type for attaching to a substantially planar structure to be lifted to facilitate the lifting thereof. The present disclosure further relates to a method of use of such connection fixtures.

BACKGROUND

There are presently a number of means available for lifting heavy structural elements. For example, large structural steel panels of the type used in the construction of large industrial facilities are commonly lifted by bolting a connection fixture to the panel to which lifting cables can be attached. Such lifting cables are operated from above by lifting devices such as cranes, hoists, winches, and the like. Frequently a spreader bar, also referred to as a spreader beam or a lifting beam, is suspended from the connection device and the lifting cables attach the load to the spreader bar.

Although the use of bolt-on connection fixtures with such devices is quite simple and has been in use for many years, it has been found that this still leaves much to be desired in terms of precise, safe and ergonomic operation. Having to manually install bolts to attach the connection fixture to each panel is extremely time-consuming and fraught with potential for human error as well as repetitive stress injury. From the perspective of the construction workers, it would be desirable to have a way to attach the connection fixture which would avoid the use of bolts. From an economic perspective, it would further be desirable to have a way to facilitate the attachment of the connection fixture without the time-consuming procedure of installing individual bolts.

SUMMARY

In one aspect, a connection fixture is provided capable of engaging holes in a substantially planar structure to be lifted. The connection fixture includes a first bracket portion for engaging one side of the substantially planar structure. The first bracket portion has a first bracket base having a length a fraction of the width of the substantially planar structure and having a first end and a second end; a generally C shaped lip extending downwardly from the first end of the first bracket base for surrounding a first edge of the substantially planar structure; and an elongated lifter portion extending upwardly from the second end of the first bracket base having a transverse hole therethrough. The connection fixture further includes a second bracket portion capable of interlocking with the first bracket portion. The second bracket portion has a second bracket base having a length substantially the width of the substantially planar structure less the length of the first bracket base and having a first end and a second end; a generally C shaped lip extending downwardly from the first end of the second bracket base for surrounding a second edge of the substantially planar structure; and an elongated lifter portion extending upwardly from the second end of the second bracket base having a transverse hole therethrough capable of aligning with the transverse hole through the elongated lifter portion of the first bracket portion. The connection fixture further includes an elongated element capable of fitting vertically between the first and second bracket portions. The elongated element is capable of moving vertically between a normally upper position and a depressed position. The elongated element has an upper portion having a transverse hole capable of aligning with the transverse holes in the elongated lifter portions of the first and second bracket portions; an optional spring loaded pin; and a lower pin capable of passing through the vertical hole in the substantially planar structure in the depressed position. The connection fixture further includes a generally C shaped shackle having a lifting hook portion and two shackle holes therein capable of fitting around the elongated lifter portions of the first and second bracket portions and aligning with the transverse holes thereof when the first and second bracket portions are interlocked; and a shackle pin or shackle screw capable of fitting through the shackle holes and the transverse holes of the elongated lifter portions of the first and second bracket portions when the first and second bracket portions are interlocked.

In another aspect, a method is provided for securing the connection fixture to a substantially planar structure to be lifted wherein the substantially planar structure has a vertical hole therein. The method includes first positioning the first bracket portion of the connection fixture such that the generally C shaped lip of the first bracket portion surrounds a first edge of the substantially planar structure. The second bracket portion of the connection fixture is then positioned such that the generally C shaped lip of the second bracket portion surrounds a second edge of the substantially planar structure; the second bracket portion interlocks with the first bracket portion; and the transverse holes of the elongated lifter portions of the first and second bracket portions are aligned. The elongated element of the connection fixture is then moved vertically into the depressed position such that the lower pin of the elongated element passes through the vertical hole in the substantially planar structure. At this point, a shackle can be attached to the connection fixture by positioning the shackle holes around the aligned transverse holes of the elongated lifter portions of the first and second bracket portions and inserting a shackle pin or screw through the shackle holes and the transverse holes of the elongated lifter portions of the first and second bracket portions.

DESCRIPTION OF THE DRAWINGS

These and other objects, features and advantages of the present invention will become better understood with reference to the following description, appended claims and accompanying drawings where:

DETAILED DESCRIPTION

A connection fixture is provided which can be securely connected to a substantially planar structure to facilitate lifting of the structure. In one embodiment, the substantially planar structure is a wind chime for use on a fluid storage tank, and the terms substantially planar structure and wind chime are used interchangeably herein. In another embodiment, the substantially planar structure is a base chime for use on a fluid storage tank.

Figure 1A:
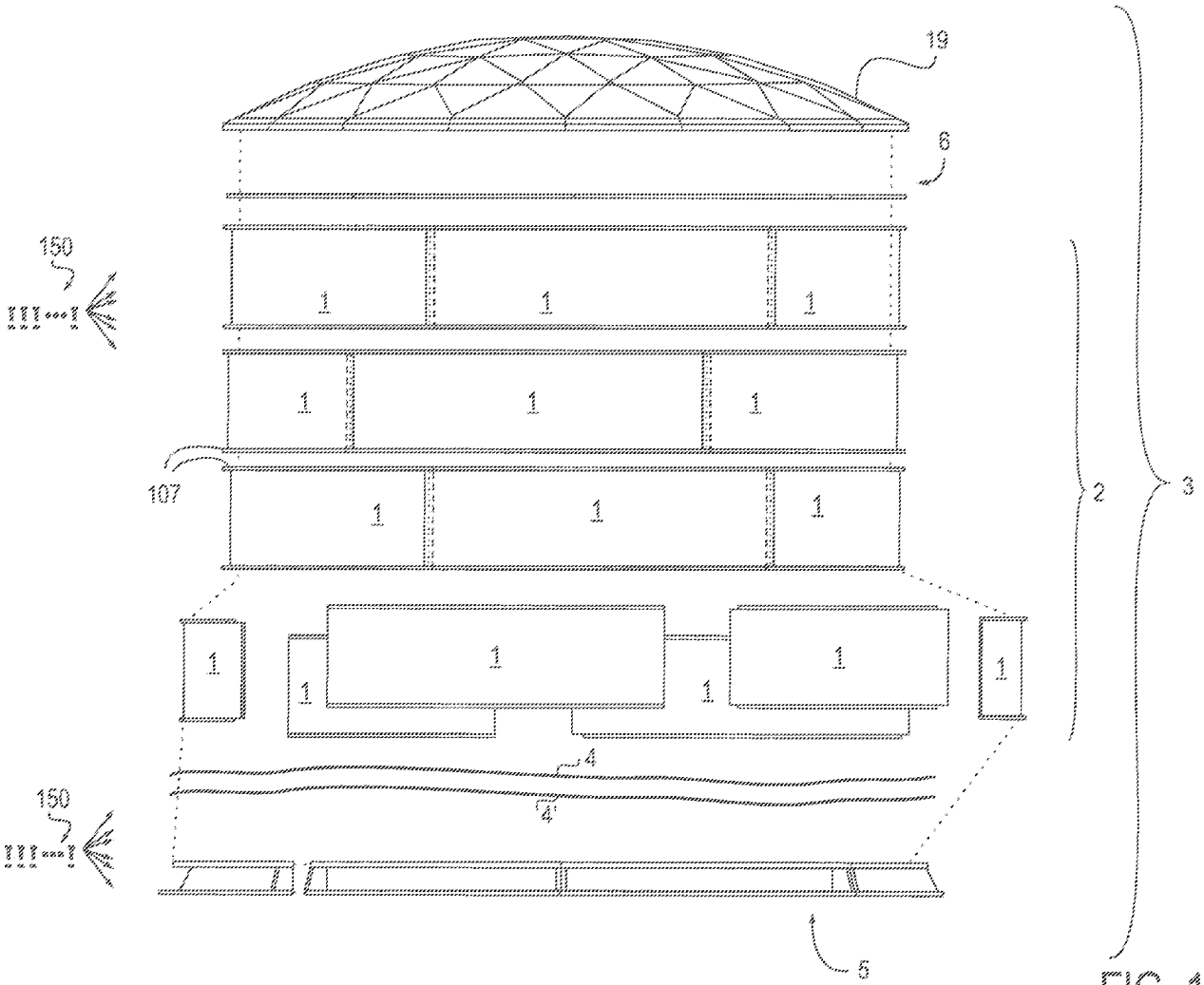
FIG. 1A is an exploded view of a fluid storage tank according to one exemplary embodiment.

FIG. 1A illustrates such a fluid storage tank 3 which is constructed of a plurality of wall panels 1 having flanged edges 107 which can be bolted together using bolts 150 to form the tank wall 2. A base ring 5 forms the base of the tank. Optional gasket material 4 and 4' can be placed over the base ring 5. The tank will have a wind chime 6 attached to the uppermost band of wall panels 1. The wind chime 6 is a substantially planar structure having a plurality of vertical holes there through. A roof 19 can optionally be attached to the wind chime 6. The present disclosure describes a connection fixture for facilitating the lifting of the substantially planar structure.

Figure 2:
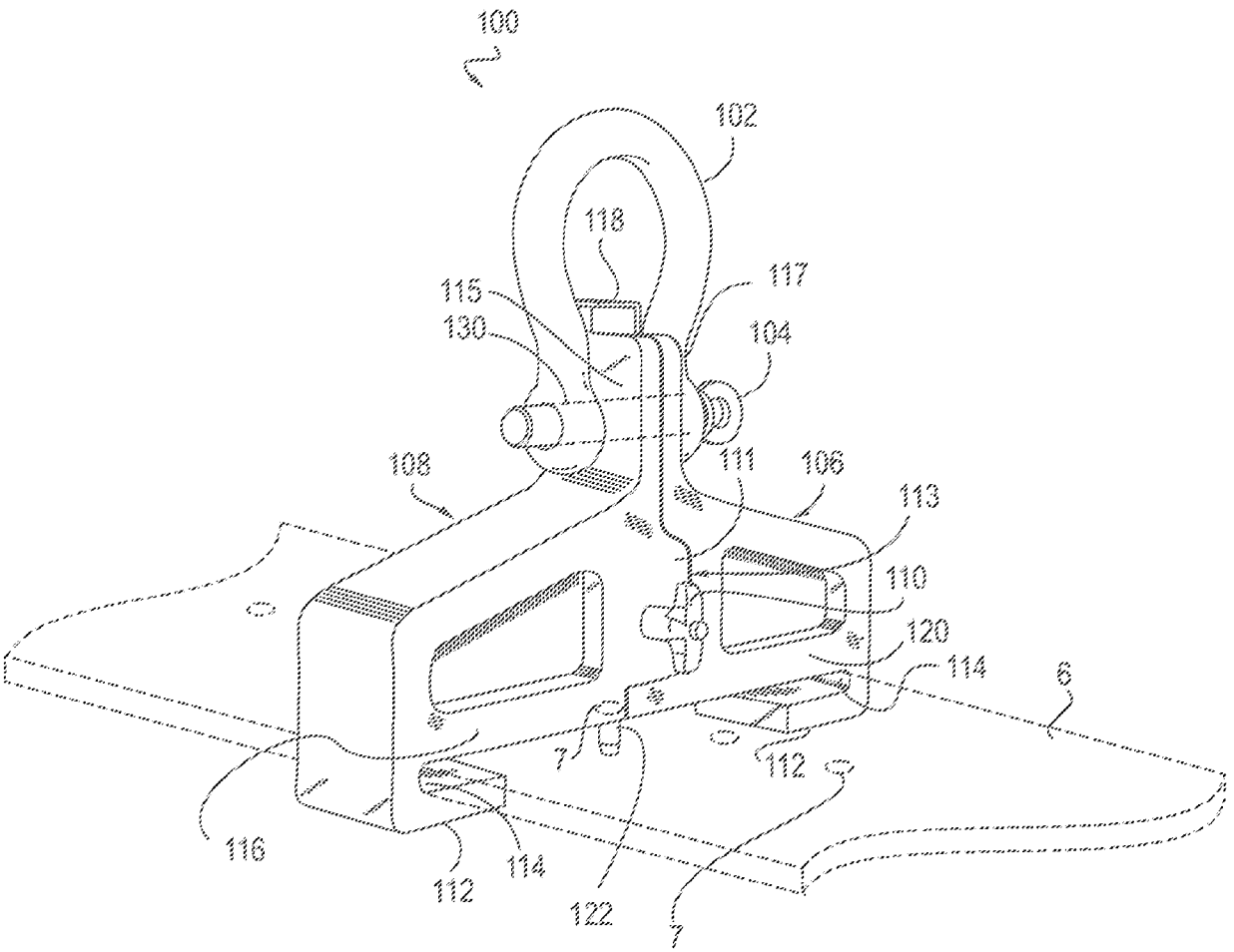
FIG. 2 is a perspective view of a connection fixture in a closed position secured to a substantially planar structure according to one exemplary embodiment.
Figure 3:
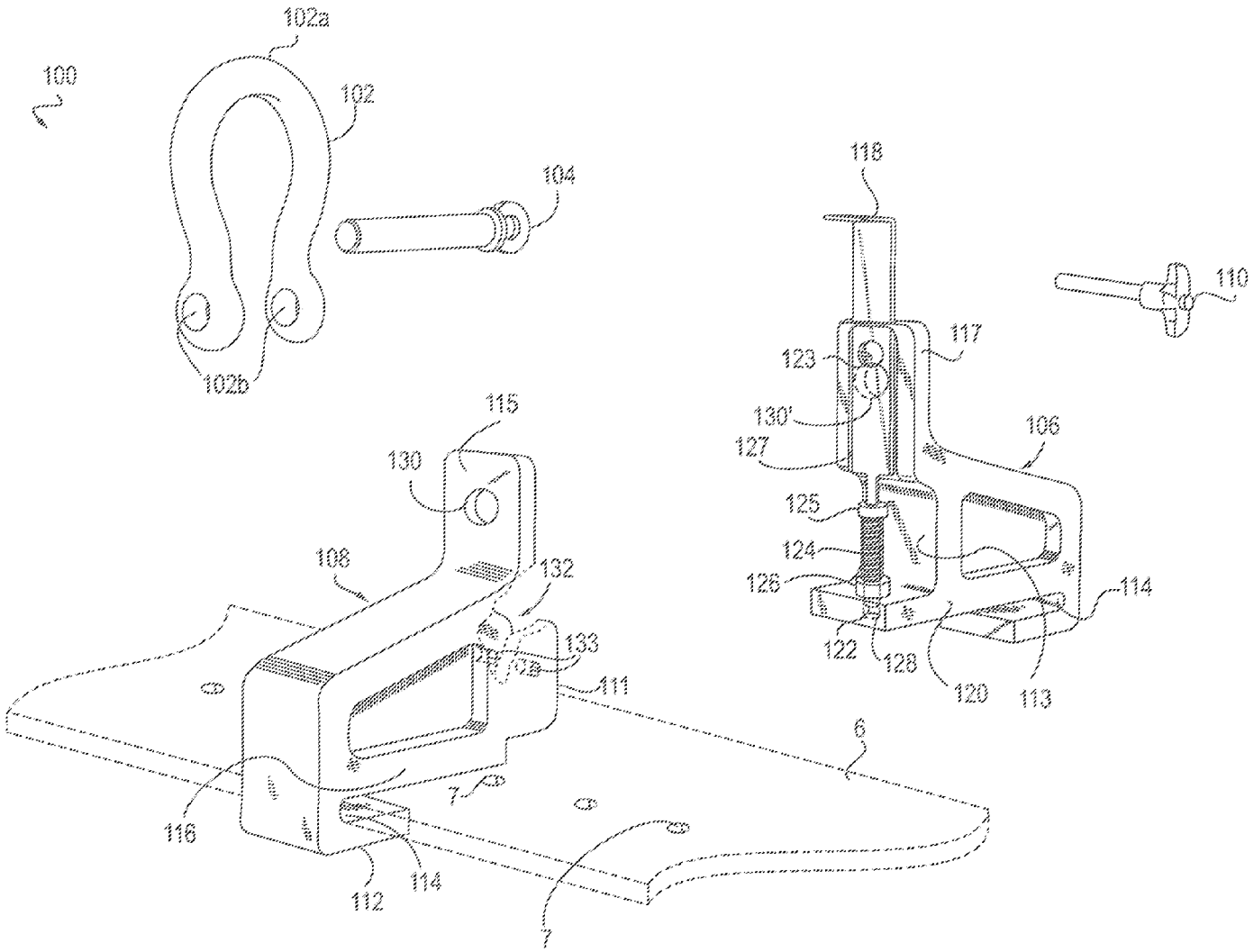
FIG. 3 is an exploded view of a connection fixture according to one exemplary embodiment.

Referring to FIG. 2 and FIG. 3, a connection fixture 100 according to one embodiment will be described. FIG. 2 is a perspective view of the connection fixture 100 in a closed position secured to a substantially planar structure 6 to be lifted (shown in phantom lines). FIG. 3 is an exploded view of the connection fixture 100. The substantially planar structure 6 has a plurality of vertical holes 7 therethrough which the connection fixture 100 is capable of engaging. The connection fixture 100 includes a first bracket portion 108 for engaging one side of the substantially planar structure 6. The first bracket portion 108 has a first bracket base 116 having a length a fraction of the width of the substantially planar structure 6 and having a first end and a second end. A generally C shaped lip 112 extends downwardly from the first end of the first bracket base 116 for surrounding a first edge 114 of the substantially planar structure 6. The first bracket portion 108 has an elongated lifter portion 115 extending upwardly from the second end of the first bracket base 116 having a transverse hole 130 therethrough. The first bracket portion 108 can have a vertical protrusion 111 extending from the second end of the first bracket base 116 having a vertical passage 132 (shown on FIG. 3) therethrough.

The connection fixture 100 further includes a second bracket portion 106 capable of interlocking with the first bracket portion 108. The second bracket portion 106 has a second bracket base 120 having a length substantially the width of the substantially planar structure 6 less the length of first bracket base 116 and having a first end and a second end. The second bracket base 120 has a hole 128 (shown on FIG. 3) therein capable of aligning with the vertical passage 132 through the vertical protrusion 111 of the first bracket portion 108 and the vertical hole 7 in the substantially planar structure 6. The second bracket portion 106 has a generally C shaped lip 112 extending downwardly from the first end of the second bracket base 120 for surrounding a second edge 114 of the substantially planar structure 6. The second bracket portion 106 has a vertical recess 113 extending from the second end of the second bracket base capable of interlocking with the vertical protrusion 111 of the first bracket portion 108. The second bracket portion 106 has an elongated lifter portion 117 extending upwardly from the second end of the second bracket base 120 having a transverse hole 130' therethrough capable of aligning with the transverse hole 130 through the elongated lifter portion 115 of the first bracket portion 108.

The transverse holes 130 and 130' align such that when a shackle 102 is installed around the elongated lifter portions 115, 117 and the shackle pin 104 is inserted, the shackle 102 is centered with respect to the center of mass across the width of the connection fixture 100 and the substantially planar structure 6. It is noted that the hole 7 in the substantially planar structure 6 need not be centered with respect to the width of the substantially planar structure 6.

The connection fixture 100 further includes an elongated element 118 fitting vertically within a vertical channel 127 in the second bracket portion 106 capable of moving vertically within the vertical channel 127 (shown on FIG. 3) between a normally upper position and a depressed position. The elongated element 118 has an upper portion having a transverse hole 123 capable of aligning with the transverse holes 130 and 130' in the elongated lifter portions of the first and second bracket portions. The elongated element 118 can have an optional spring loaded pin 124 capable of passing through the vertical passage 132 in the first bracket portion 108 in the depressed position when the first and second bracket portions are interlocked. The elongated element 118 has a lower pin 122 capable of aligning with and passing through the hole 128 and the vertical hole 7 in the substantially planar structure 6 in the depressed position.

The connection fixture 100 further includes a generally C shaped shackle 102 having a lifting hook portion **102*a* and two shackle holes 102*b* therein capable of fitting around the elongated lifter portions 115, 117 of the first and second bracket portions 108, 106 and aligning with the transverse holes 130 and 130' thereof when the first and second bracket portions are interlocked. A shackle pin 104 (or shackle screw) is capable of fitting through the shackle holes 102*b* and the transverse holes 130 and 130' of the elongated lifter portions of the first and second bracket portions when the first and second bracket portions are interlocked to secure the connection fixture 100** in place.

A method of securing the connection fixture 100 to a substantially planar structure 6 having a width and having a vertical hole 7 therethrough will be described with reference to FIG. 3 and FIG. 4. The method includes first positioning the first bracket portion 108 such that the generally C shaped lip 112 of the first bracket portion 108 surrounds one edge 114 of the substantially planar structure 6 and the vertical passage 132 through the vertical protrusion 111 extending from the second end of the first bracket base 116 of the first bracket portion 108 is aligned with the vertical hole 7 through the substantially planar structure 6. The second bracket portion 106 is then positioned such that the generally C shaped lip of the second bracket portion 112 surrounds the other edge 114 of the substantially planar structure 6. The vertical recess 113 of the second bracket portion 106 interlocks with the vertical protrusion 111 of the first bracket portion 108. The transverse holes 130 and 130' of the elongated lifter portions 115, 117 of the first and second bracket portions 108, 106 are aligned. The elongated element 118 of the connection fixture is then moved vertically into the depressed position such that the lower pin 122 of the elongated element passes through the vertical hole 7 in the substantially planar structure 6. If the connection fixture 100 is provided with optional spring loaded pin 124, crosswise holes 133 are provided through the first bracket portion 108 for receiving a quick release locking pin 110 above the spring loaded pin 124 passing there within to lock the device 100 in place before the shackle 102 is installed. At this point, the shackle 102 can be attached to the connection fixture 100 by positioning the shackle holes **102*b* around the aligned transverse holes 130 and 130' of the elongated lifter portions 115, 117 of the first and second bracket portions 108, 106 and inserting a shackle pin 104 (or screw) through the shackle holes 102***a* and the transverse holes 130 and 130' of the elongated lifter portions of the first and second bracket portions.

Figure 4:
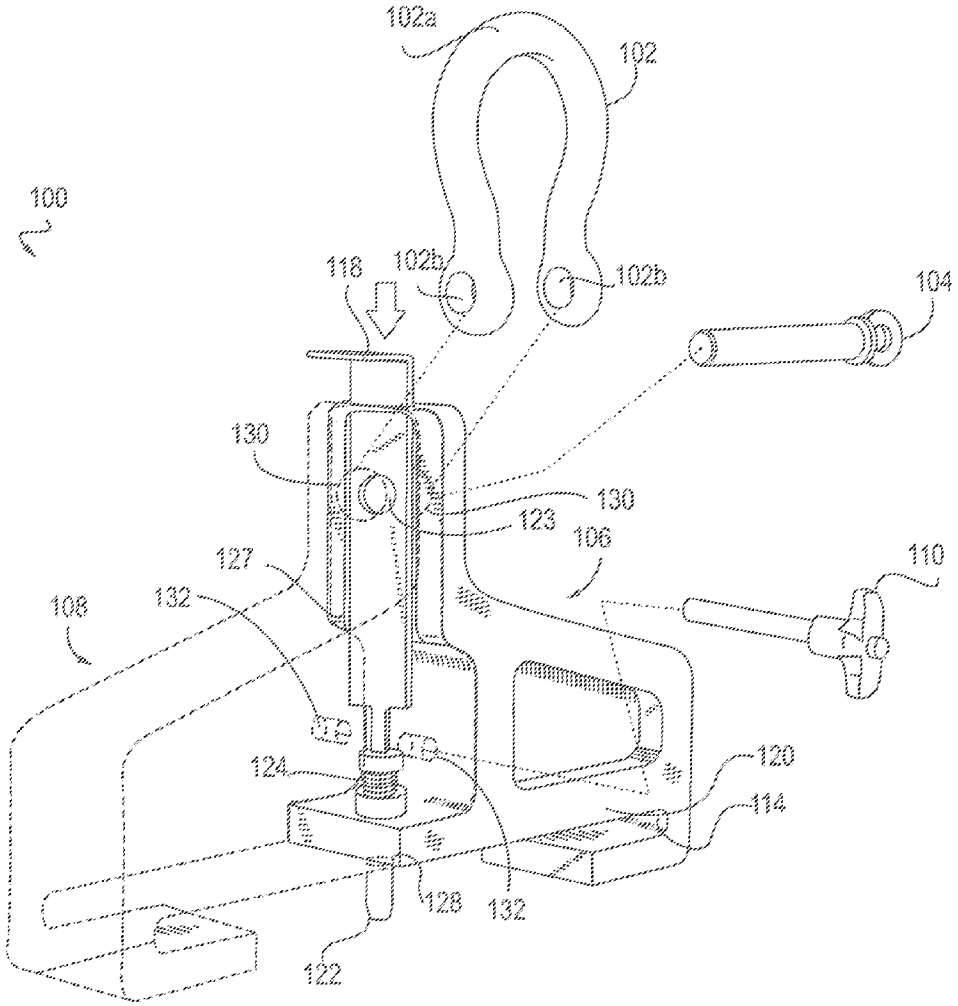
FIG. 4 is a partially assembled exploded view of a connection fixture according to one exemplary embodiment.
Figure 5:
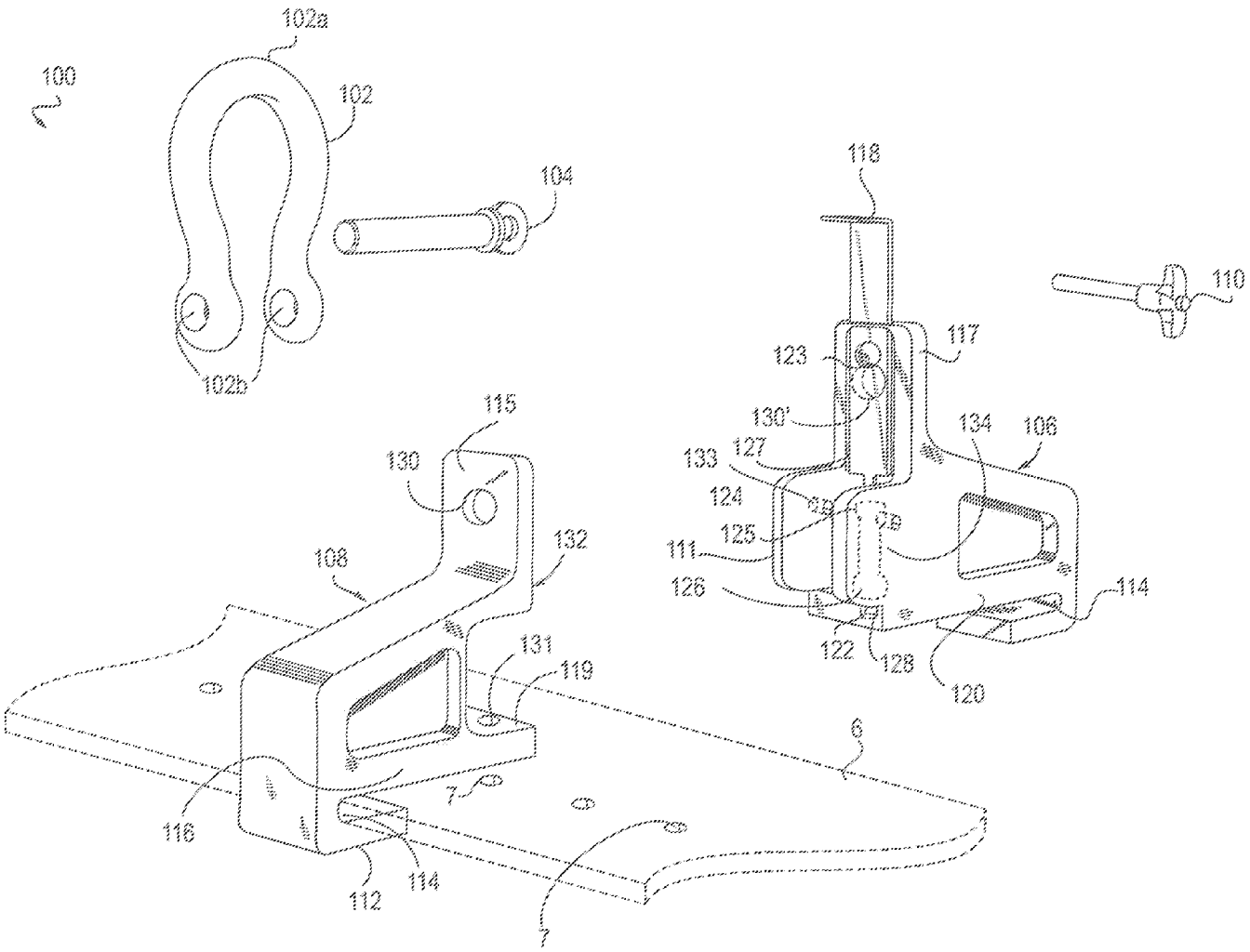
FIG. 5 is an exploded view of a connection fixture according to another exemplary embodiment.

In another embodiment, shown in FIG. 5, the connection fixture 100 differs from that shown in FIGS. 2-4 in that a tab 119 extends from the first bracket base 116, and the first bracket portion 108 contains a vertical recess between the elongated lifter portion 115 and the tab 119. The tab 119 has a hole 131 therein that can be aligned with a vertical hole 7 through the substantially planar structure 6. The second bracket base 120 can mate with the tab 119. The second bracket portion 106 has a vertical protrusion 125 extending beyond the second end of the second bracket base 120 vertically between the base 120 and the elongated lifter portion 117 and having a vertical channel 127 therethrough capable of aligning with the hole 131 in the tab 119 of the first bracket portion 108. The elongated element 118 fits within the vertical channel 127 in the vertical protrusion 125 of the second bracket portion 106. Again, the elongated element 118 is capable of moving vertically between a normally upper position and a depressed position, the elongated element 118 having an upper portion having a transverse hole 123 capable of aligning with the transverse holes 130, 130' in the elongated lifter portions of the first and second bracket portions 108, 106.

Figure 6:
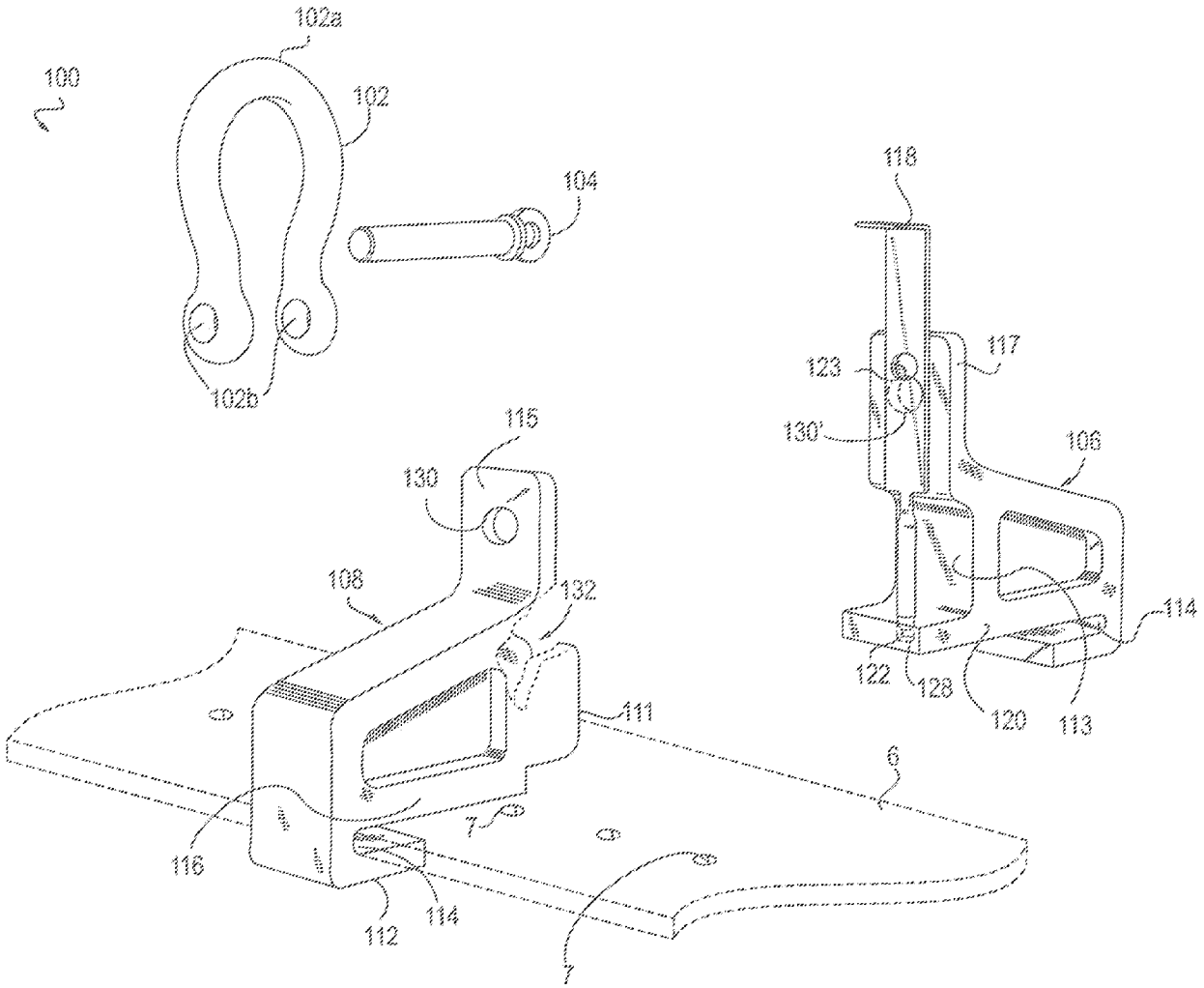
FIG. 6 is an exploded view of a connection fixture according to another exemplary embodiment.

In another embodiment, shown in FIG. 6, the connection fixture 100 differs from the previous described embodiments in that no spring loaded pin is provided as part of the elongated element 118. Furthermore, no vertical channel is provided as part of either the first or second bracket portion. As can be seen from the embodiments described, elongated element 118 of the connection fixture 100 can either be fixed within a vertical channel 127 within the first or second bracket portion (preassembled with the bracket portion), or it may be a separate component.

Figure 7A:
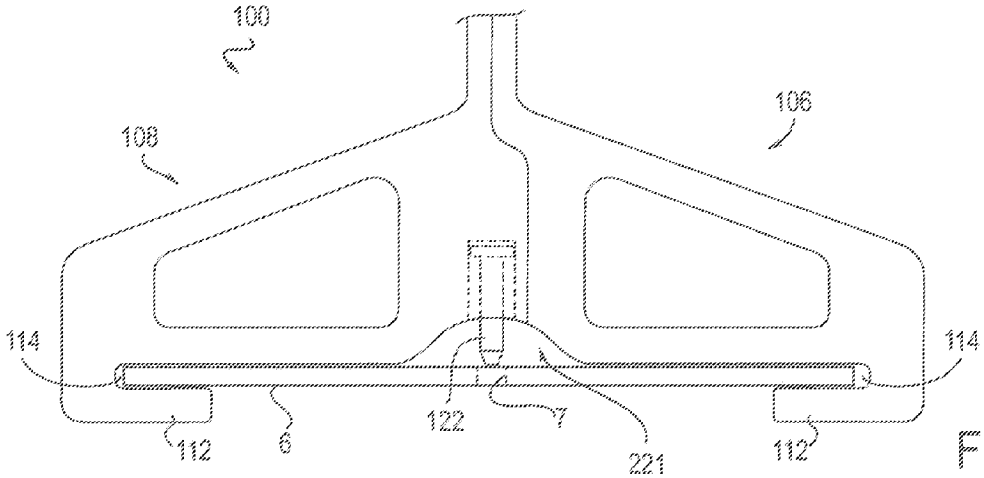
FIGS. 7A and 7B are side views of a connection fixture according to another exemplary embodiment illustrating two positions, respectively.
Figure 7B:
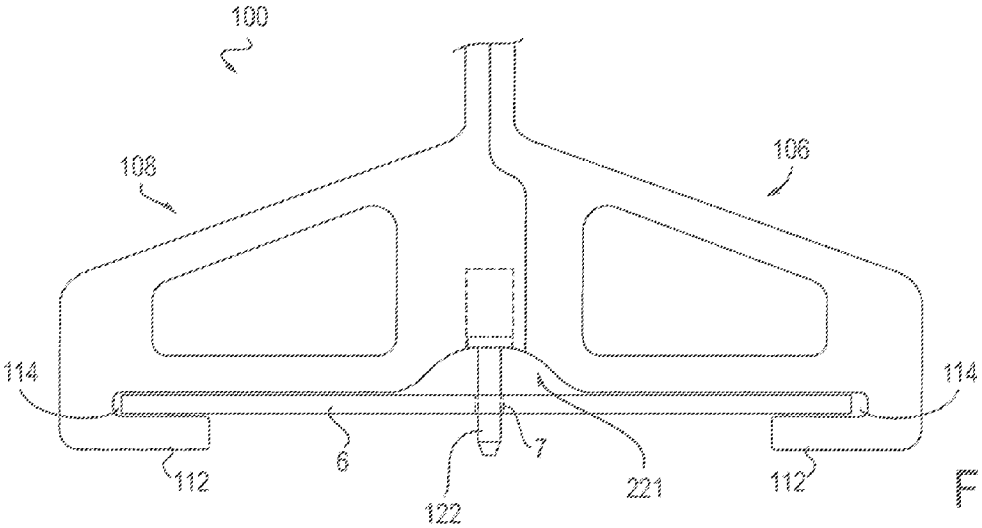

FIGS. 7A and 7B illustrate an alternative embodiment in which a cut-out section 221 is provided to allow visual confirmation of the location of the lower pin 122 relative to the hole 7 in the planar structure 6. FIG. 7A shows the elongated element in the normal upper position with pin 122 above the hole 7 in the substantially planar structure 6. FIG. 7B shows the elongated element in the depressed position with pin 122 inserted through the hole 7 in the substantially planar structure 6.

The first and second bracket portions 108, 106 can be formed of a metallic material selected from the group consisting of iron, steel, aluminum, and alloys thereof. The metallic material can be extruded and finished by milling to the exact desired dimensions.

Figure 1B:
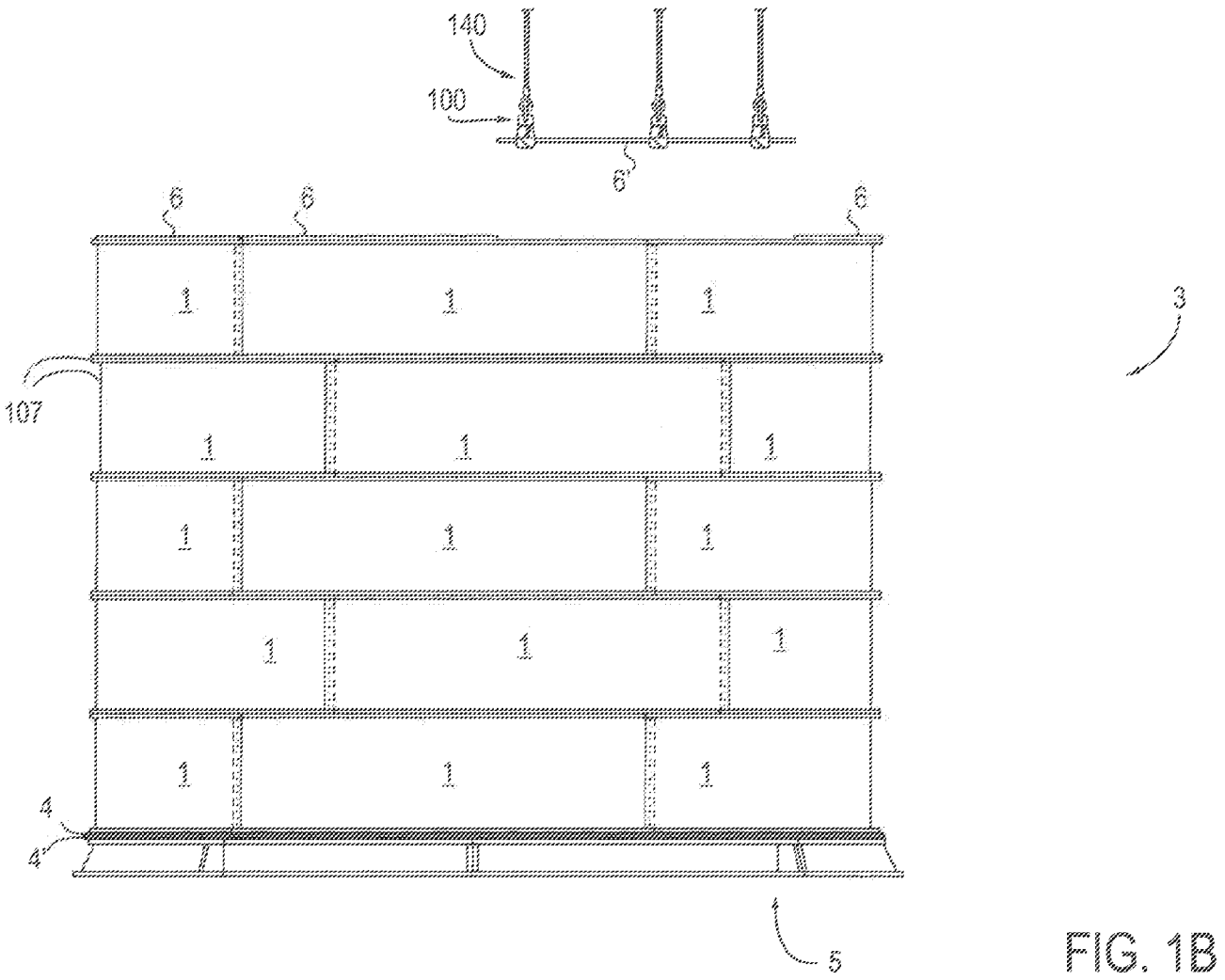
FIG. 1B is an illustration of a method to install a wind chime on a fluid storage tank using a connection fixture according to one exemplary embodiment.

FIG. 1B illustrates a method to install a wind chime 6 on a fluid storage tank 3 using the connection fixture 100 according to one embodiment. Connection fixtures 100 are secured to the wind chime 6 as described herein. Steel rope 140 suspended from a crane (not shown) can then be attached to the shackles of the connection fixtures 100 to facilitate lifting the wind chime 6.

Desirably, a tether or lanyard can be attached from the steel rope 140 suspended from the crane to each component of the connection fixture 100 to prevent any component from falling to the ground or onto anything or anyone below the height of the connection fixture 100.

It is an advantage of the present connection fixture that it can be installed on the structure to be lifted without the use of bolts and by extension, without the use of corresponding nuts. The steps involved in installing the connection fixture are less time-consuming and more ergonomically friendly than conventional methods using known connection devices.

It is another advantage of the present connection fixture that in the event that the connection fixture is used to lift an excessive load exceeding the yield strength of the first and second bracket portions, physical distortion of the first and/or second bracket portion(s) will result, and the connection fixture will no longer be operable in that the device can no longer be moved into the closed position.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A connection fixture for engaging and securely holding a substantially planar structure having a width and having a vertical hole therethrough, comprising:

a. a first bracket portion for engaging one side of the substantially planar structure, the first bracket portion having:
   i. a first bracket base having a length a fraction of the width of the substantially planar structure and having a first end and a second end;
   ii. a generally C shaped lip extending downwardly from the first end of the first bracket base for surrounding a first edge of the substantially planar structure; and
   iii. an elongated lifter portion extending upwardly from the second end of the first bracket base having a transverse hole therethrough;

b. a second bracket portion capable of interlocking with the first bracket portion, the second bracket portion having:
   i. a second bracket base having a length substantially the width of the substantially planar structure less the length of the first bracket base and having a first end and a second end;
   ii. a generally C shaped lip extending downwardly from the first end of the second bracket base for surrounding a second edge of the substantially planar structure; and
   iii. an elongated lifter portion extending upwardly from the second end of the second bracket base having a transverse hole therethrough capable of aligning with the transverse hole through the elongated lifter portion of the first bracket portion;

c. an elongated element fitting vertically within a vertical channel located in the first bracket portion, in the second bracket portion or between the first bracket portion and the second bracket portion, the elongated element being capable of moving vertically between a normally upper position and a depressed position, the elongated element comprising:
   i. an upper portion having a transverse hole capable of aligning with and between the transverse holes in the elongated lifter portions of the first and second bracket portions; and
   ii. a lower pin capable of aligning with and passing through the vertical hole in the substantially planar structure in the depressed position;

d. a generally C shaped shackle having a lifting hook portion and two shackle holes therein capable of fitting around the elongated lifter portions of the first and second bracket portions and aligning with the transverse holes thereof when the first and second bracket portions are interlocked; and e. a shackle pin or shackle screw capable of fitting through the shackle holes and the transverse holes of the elongated lifter portions of the first and second bracket portions when the first and second bracket portions are interlocked.

2. The connection fixture of claim 1, wherein the elongated element further comprises a spring loaded pin between the upper portion and the lower pin of the elongated element.

3. The connection fixture of claim 2, wherein the second bracket portion further comprises a crosswise hole for receiving a quick release locking pin above the spring loaded pin passing there within; and wherein the connection fixture further comprises a quick release locking pin for inserting into the crosswise hole when the first and second bracket portions are interlocked and the elongated element is depressed.

4. The connection fixture of claim 1, wherein:

a. the first bracket portion further comprises a tab extending from the second end of the first bracket base having a vertical hole therethrough wherein a vertical recess is present between the tab and the elongated lifter portion of the first bracket portion;

b. the second bracket portion further comprises a notch extending from the second end of the second bracket base capable of interlocking with the tab of the first bracket portion and a vertical protrusion extending beyond the second end of the second bracket base vertically between the notch and the elongated lifter portion of the second bracket portion capable of interlocking with the vertical recess of the first bracket portion and having a vertical channel therethrough capable of aligning with the vertical hole in the tab of the first bracket portion; and c. the elongated element fits within the vertical channel in the vertical protrusion of the second bracket portion.

5. The connection fixture of claim 1, wherein:

a. the first bracket portion further comprises a tab extending from the second end of the first bracket base having a vertical hole therethrough wherein a vertical recess is present between the tab and the elongated lifter portion of the first bracket portion;

b. the second bracket portion further comprises a notch extending from the second end of the second bracket base capable of interlocking with the tab of the first bracket portion; and c. the vertical channel in which the elongated element fits is located in the first bracket portion.

6. The connection fixture of claim 1, wherein the first and second bracket portions comprise a metallic material selected from the group consisting of iron, steel, aluminum, and alloys thereof.

7. A method for securing the connection fixture of claim 1 to a substantially planar structure having a width and having a vertical hole therethrough, comprising:

a. positioning the first bracket portion of the connection fixture such that the generally C shaped lip of the first bracket portion surrounds a first edge of the substantially planar structure;

b. positioning the second bracket portion of the connection fixture such that the generally C shaped lip of the second bracket portion surrounds a second edge of the substantially planar structure; the second bracket portion interlocks with the first bracket portion; and the transverse holes of the elongated lifter portions of the first and second bracket portions are aligned;

c. moving the elongated element of the connection fixture vertically into the depressed position such that the lower pin of the elongated element passes through the vertical hole in the substantially planar structure;

d. placing the generally C shaped shackle of the connection fixture around the elongated lifter portions of the first and second bracket portions such that the shackle holes are aligned with the transverse holes of the elongated lifter portions of the first and second bracket portions; and e. inserting the shackle pin or shackle screw of the connection fixture through the shackle holes and the transverse holes of the elongated lifter portions of the first and second bracket portions.

8. The method of claim 7, wherein no bolts are fastened through the substantially planar structure in securing the connection fixture to the substantially planar structure.

* * * * *